US009330586B2

(12) United States Patent
Pyun et al.

(10) Patent No.: US 9,330,586 B2
(45) Date of Patent: May 3, 2016

(54) LIQUID CRYSTAL DISPLAY

(71) Applicant: Samsung Display Co., Ltd., Yongin (KR)

(72) Inventors: Kihyun Pyun, Goyang-si (KR); Sung-In Kang, Asan-si (KR); Jun-Ho Hwang, Daegu (KR); Seung-Woon Shin, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 300 days.

(21) Appl. No.: 13/686,284

(22) Filed: Nov. 27, 2012

(65) Prior Publication Data

US 2013/0201174 A1 Aug. 8, 2013

(30) Foreign Application Priority Data

Feb. 8, 2012 (KR) ..... 10-2012-0013008

(51) Int. Cl.
*G09G 3/36* (2006.01)
*G09G 1/00* (2006.01)

(52) U.S. Cl.
CPC ..... *G09G 1/005* (2013.01); *G09G 3/3607* (2013.01); *G09G 3/3614* (2013.01); *G09G 3/3677* (2013.01); *G09G 2310/0289* (2013.01)

(58) Field of Classification Search
CPC ..... G09G 3/36
USPC ..... 345/87–104
See application file for complete search history.

(56) References Cited

U.S. PATENT DOCUMENTS

| | | | | |
|---|---|---|---|---|
| 7,554,021 | B2 | 6/2009 | Stupp et al. | |
| 7,776,343 | B1 | 8/2010 | Cox et al. | |
| 8,026,887 | B2 | 9/2011 | Koo et al. | |
| 2006/0208991 | A1 * | 9/2006 | Uekuri et al. | 345/98 |
| 2007/0216632 | A1 * | 9/2007 | Lee | 345/100 |
| 2008/0180462 | A1 * | 7/2008 | Nose | 345/690 |
| 2009/0043879 | A1 | 2/2009 | Jamieson et al. | |
| 2009/0225018 | A1 * | 9/2009 | Kim | 345/90 |
| 2010/0085336 | A1 * | 4/2010 | Yang et al. | 345/205 |
| 2010/0238151 | A1 * | 9/2010 | Kitayama et al. | 345/209 |
| 2012/0293762 | A1 * | 11/2012 | Shin et al. | 349/139 |

FOREIGN PATENT DOCUMENTS

| | | |
|---|---|---|
| JP | 4179800 | 9/2008 |
| JP | 2011-197353 | 10/2011 |
| KR | 10-0608975 | 7/2006 |
| KR | 10-0618799 | 8/2006 |
| KR | 10-2007-0066039 | 6/2007 |

(Continued)

*Primary Examiner* — Vijay Shankar
*Assistant Examiner* — Cory Almeida
(74) *Attorney, Agent, or Firm* — H.C. Park & Associates, PLC

(57) ABSTRACT

A display apparatus including a plurality of pixels arranged in association with a plurality of gate lines and a plurality of data lines crossing the gate lines, a data driver configured to drive the data lines, a gate driving unit configured to drive the gate lines in synchronization with a gate control signal, and a timing controller configured to control the data driver and the gate driving unit in response to an image signal and a control signal from an exterior. The timing controller outputs the gate control signal including a plurality of pulses respectively corresponding to the gate lines and an enable time of each pulse of the gate control signal is set according to a position of a corresponding gate line of the gate lines.

6 Claims, 10 Drawing Sheets

(56) References Cited

FOREIGN PATENT DOCUMENTS

| | | |
|---|---|---|
| KR | 10-0806898 | 2/2008 |
| KR | 10-0806907 | 2/2008 |
| KR | 10-0846461 | 7/2008 |
| KR | 10-2009-0059506 | 6/2009 |
| KR | 10-2010-0118356 | 11/2010 |
| KR | 10-2011-0066777 | 6/2011 |

* cited by examiner

LIQUID CRYSTAL DISPLAY

CROSS-REFERENCE TO RELATED APPLICATION

This application claims priority from and the benefit of Korean Patent Application No. 10-2012-0013008, filed on Feb. 8, 2012, which is incorporated by reference for all purposes as if fully set forth herein.

BACKGROUND

1. Field

Exemplary embodiments of the present invention relate to a display apparatus and a liquid crystal display.

2. Discussion of the Background

In general, a liquid crystal display includes a liquid crystal panel for displaying an image, and data and gate drivers for driving the liquid crystal panel. The liquid crystal panel includes a plurality of gate lines, a plurality of data lines, and a plurality of sub-pixels. Each sub-pixel includes a thin film transistor and a liquid crystal capacitor. The data driver applies a gray scale voltage to the data lines and the gate driver applies a gate signal to the gate lines.

The gate driver sequentially applies the gate signal to the gate lines. Since the gate driver sequentially applies the gate signal from a first gate line to a last gate line of the gate lines, the gate signal applied to the last gate line is delayed relative to the gate signal applied to the first gate line. The delay of the gate signal causes deterioration of the image display quality.

SUMMARY OF THE INVENTION

Exemplary embodiments of the present invention provide a liquid crystal display capable of preventing deterioration in image display quality resulting from a gate signal delay.

Additional features of the invention will be set forth in the description which follows, and in part will be apparent from the description, or may be learned by practice of the invention.

An exemplary embodiment of the present invention discloses a display apparatus including a plurality of pixels arranged in association with a plurality of gate lines and a plurality of data lines crossing the gate lines, a data driver configured to drive the data lines, a gate driving unit configured to drive the gate lines in synchronization with a gate control signal, and a timing controller configured to control the data driver and the gate driving unit in response to an image signal and an external control signal. The timing controller outputs the gate control signal including a plurality of pulses respectively corresponding to the gate lines, and an enable time of the pulses of the gate control signal is set according to a position of a corresponding gate line of the gate lines.

An exemplary embodiment of the present invention also discloses a plurality of pixels arranged in association with a plurality of gate lines and a plurality of data lines crossing the gate lines, a timing controller configured to output a first control signal and a second control signal in response to an image signal and an external control signal, a data driver configured to drive the data lines in response to the first control signal, a level shifter configured to generate a gate clock signal in response to a gate pulse signal, and a gate driver configured to drive the gate lines in response to the gate clock signal and the second control signal. The timing controller outputs the gate pulse signal having charge sharing times respectively corresponding to the gate lines, and each charge sharing time of the gate pulse signal is set according to a position of a corresponding gate line of the gate lines.

An exemplary embodiment of the present invention also discloses a plurality of pixels arranged in association with a plurality of gate lines and a plurality of data lines crossing the gate lines, a timing controller configured to output a first control signal and a second control signal in response to an image signal and an external control signal, a voltage generator configured to output a first operation voltage and a second operation voltage in response to a kickback voltage, a gate driver configured to drive the gate lines in response to the second control signal and the first and second operation voltages. The timing controller outputs the kickback signal having enable times respectively corresponding to the gate lines, and each enable time of the kickback signal is set according to a position of a corresponding gate line of the gate lines.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
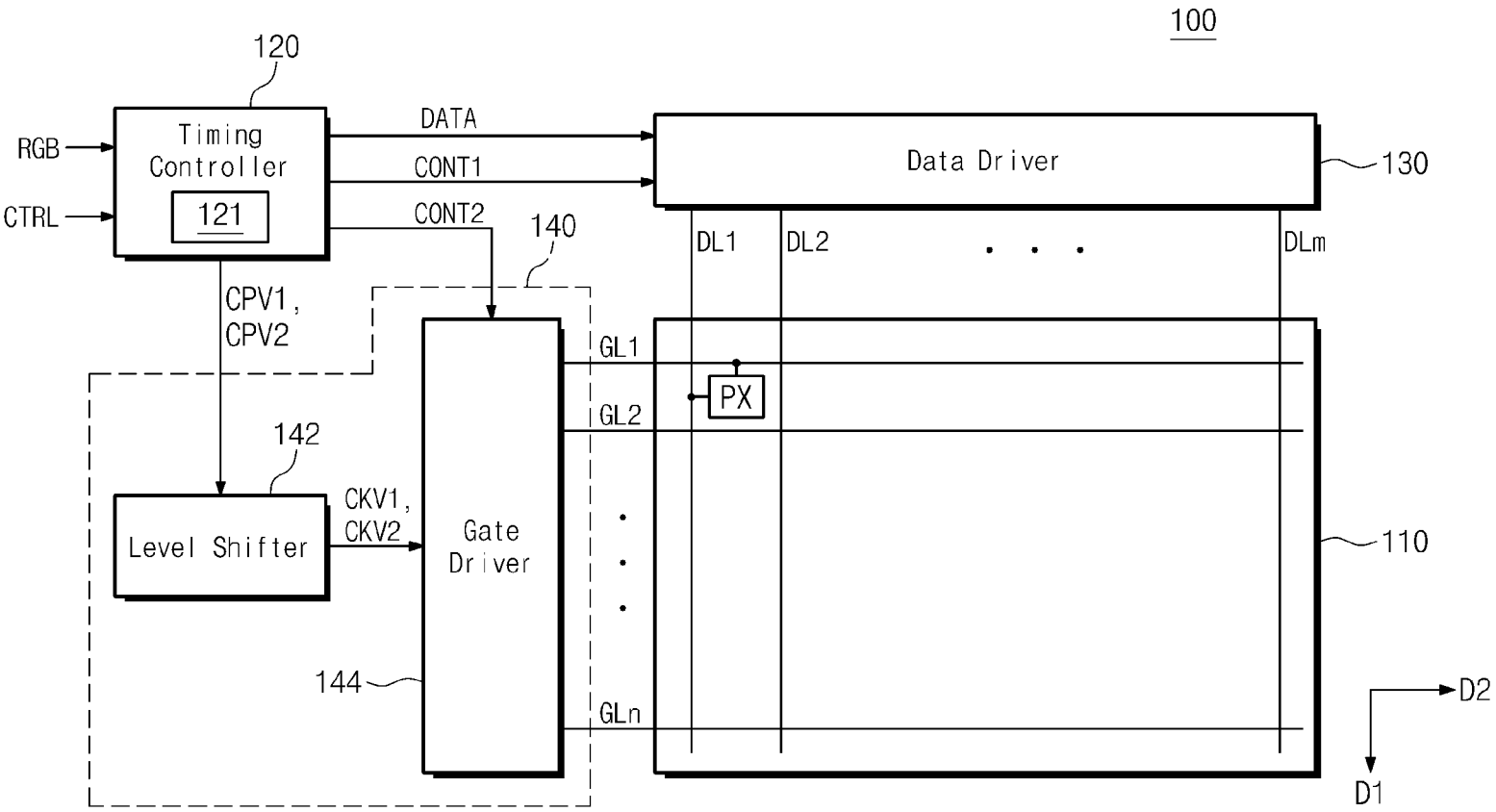
FIG. 1 is a block diagram showing a liquid crystal display according to a first exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present. It will be understood that for the purposes of this disclosure, "at least one of X, Y, and Z" can be construed as X only, Y only, Z only, or any combination of two or more items X, Y, and Z (e.g., XYZ, XYY, YZ, ZZ).

FIG. 1 is a block diagram showing a liquid crystal display according to a first exemplary embodiment of the present invention.

Referring to FIG. 1, a liquid crystal display 100 includes a liquid crystal panel 110, a timing controller 120, a data driver 130, and a gate driving unit 140. The gate driving unit 140 includes a level shifter 142 and a gate driver 144.

The liquid crystal panel 110 includes a plurality of data lines DL1 to DLm extending in a first direction D1, a plurality of gate lines GL1 to GLn extending in a second direction D2 and crossing the data lines DL1 to DLm, and a plurality of sub-pixels PX arranged in association with the data lines DL1 to DLm and the gate lines GL1 to GLn.

Although not shown in FIG. 1, each sub-pixel PX includes a switching transistor connected to a corresponding data line of the data lines DL1 to DLm and a corresponding gate line of the gate lines GL1 to GLn, a liquid crystal capacitor, and a storage capacitor, which are connected to the switching transistor.

The timing controller 120 receives image signals RGB and control signals CTRL, such as a vertical synchronization signal Vsync, a horizontal synchronization signal Hsync, a main clock signal MCLK, a data enable signal DE, etc., to control the display of the image signals RGB. The timing controller 120 provides a data signal DATA, which is obtained by processing the image signals RGB based on the control signals CTRL, and a first control signal CONT1 to the data driver 130, and provides a second control signal CONT2 to the gate driver 144. The first control signal CONT1 includes a horizontal synchronization start signal STH, a clock signal HCLK, and a line latch signal TP, and the second control signal CONT2 includes a vertical synchronization start signal STV1 and an output enable signal OE.

The data driver 140 outputs gray scale voltages in response to the data signal DATA and the first control signal CONT1 from the timing controller 120 to drive the data lines DL1 to DLm.

The level shifter 142 outputs a first gate clock signal CKV1 and a second gate clock signal CKV2 in response to a first gate pulse signal CPV1 and a second gate pulse signal CPV2 from the timing controller 120.

The gate driver 144 drives the gate lines GL1 to GLn in response to the second control signal CONT2 from the timing controller 120 and the first and second clock signals CKV1 and CKV2 from the level shifter 140. The gate driver 144 includes a gate driving integrated circuit. The gate driving integrated circuit may be embodied in various forms, such as an amorphous silicon gate (ASG) circuit by using an amorphous silicon thin film transistor (a-Si TFT).

When a gate-on voltage is applied to one gate line, switching transistors connected to the one gate line are turned on and the data driver 140 provides the gray scale voltages corresponding to the data signal DATA to the data lines DL1 to DLm. The gray scale voltages provided to the data lines DL1 to DLm are applied to corresponding sub-pixels through the turned-on switching transistors. In the first exemplary embodiment, the period during which the switching transistors arranged in one row are turned on, i.e., one period of the data enable signal DE and the first and second gate clock signals CKV1 and CKV2, is called "one horizontal period" or "1H". In the first exemplary embodiment, the gate lines GL1 to GLn are driven in a gate line precharge driving manner in which an earlier H/2 period among the one horizontal period (1H) during which the gate-on voltage VON is applied to a corresponding one gate line of the gate lines GL1 to GLn is overlapped with a later H/2 period among the one horizontal period (1H) during which the gate-on voltage is applied to a previous gate line of the corresponding one gate line. The gate line precharge driving manner compensates for the reduced charging time of the liquid crystal capacitor, which is caused by the increase in the number of the gate lines.

Figure 2:
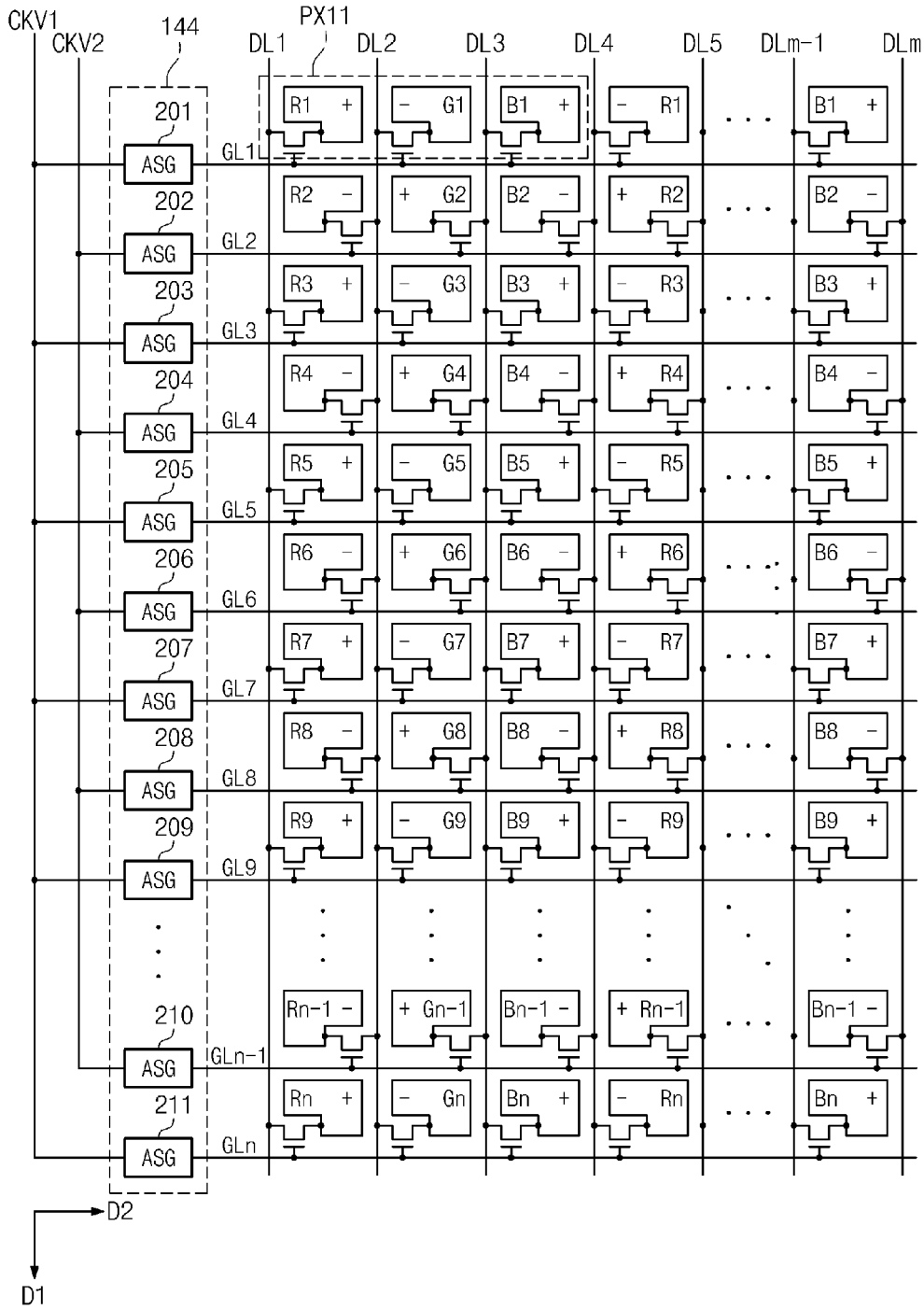
FIG. 2 is a circuit diagram showing a configuration of a gate driver and an arrangement of pixels in a liquid crystal panel shown in FIG. 1.

FIG. 2 is a circuit diagram showing a configuration of a gate driver and an arrangement of pixels in a liquid crystal panel shown in FIG. 1.

Referring to FIG. 2, the gate driver 144 includes a plurality of amorphous silicon gate (ASG) circuits 201 to 211 respectively corresponding to the gate lines GL1 to GLn. The first gate clock signal CKV1 from the level shifter 142 is applied to the ASG circuits 201, 203, 205, 207, 209, and 210 respectively corresponding to odd-numbered gate lines GL1, GL3, GL5, GL7, GL9, and GLn-1 among the gate lines GL1 to GLn. The second gate clock signal CKV2 from the level shifter 142 is applied to the ASG circuits 202, 204, 206, 208, and 211 respectively corresponding to even-numbered gate lines GL2, GL4, GL6, GL8, GL, and GLn. In FIG. 2, the gate driver 144 is configured to include the ASG circuits 201 to 211, but the gate driver 144 may include other configurations instead of the ASG circuits 201 to 211. For example, the gate driver 144 may be configured to be implemented as an integrated circuit.

Each pixel includes three sub-pixels. For example, each pixel includes three sub-pixels R1, G1, and B1 respectively corresponding to red, green, and blue colors, and three switching transistors respectively connected to the sub-pixels R1, G1, and B1. Each of the switching transistors is connected to a corresponding gate line of the gate lines GL1 to GLn and a corresponding data line of the data lines DL1 to DLm. The sub-pixels R1, G1, and B1 are sequentially arranged in the second direction D2 in which the gate lines GL1 to GLn extend, and the sub-pixels having the same color are arranged in the first direction D1 in which the data lines DL1 to DLm extend. For instance, red sub-pixels R1 to Rn are placed at the right side of the first data line DL1, green sub-pixels G1 to Gn are placed between the second and third data lines DL2 and DL3, and blue sub-pixels B1 to Bn are placed at the right side of the third data line DL3. In the first exemplary embodiment, the sub-pixels are arranged in the second direction D2 in the order of the red sub-pixel, the green sub-pixel, and the blue sub-pixel, but the arrangement of the sub-pixels may be arranged in various orders, e.g., R-B-G, G-B-R, G-R-B, B-R-G, B-G-R, etc.

Referring to FIG. 2, a portion of the sub-pixels R1 to Rn, G1 to Gn, and B1 to Bn is connected to the data line disposed at a left side thereof and a remaining portion of the sub-pixels R1 to Rn, G1 to Gn, and B1 to Bn is connected to the data line disposed at a right side thereof. In detail, switching transistors of the sub-pixels connected to odd-numbered gate lines GL1, GL3, GL5, . . . , GLn-1 are connected to the data line placed at the left side thereof, and switching transistors of the sub-pixels connected to even-numbered gate lines GL2, GL4, GL6, . . . , GLn are connected to the data line placed at the right side thereof. In other words, the sub-pixels are alternately connected to the data line placed at the left side and the data line placed at the right side, and this is referred to as a "zigzag structure."

In more detail, the switching transistors of the sub-pixels connected to the first gate line GL1 are connected to the data line placed at the left side thereof, and the switching transistors of the sub-pixels connected to the second gate line GL2 are connected to the data line placed at the right side thereof.

As described above, the data lines DL1 to DLm may be driven in a column inversion manner in order to precharge the gate lines GL1 to GLn. In the column inversion manner, a polarity of the gray scale voltage applied to each data line is opposite to a polarity of the gray scale voltage applied to adjacent data lines thereto, with reference to a common voltage.

According to the connection relation of the sub-pixels and the data lines, an apparent inversion that occurs on the display screen is the same as a dot inversion even though the data lines DL1 to DLm are driven in the column inversion manner by the data driver 140. That is, the gray scale voltages applied to adjacent sub-pixels have complementary polarities. When the apparent inversion becomes the dot inversion, a brightness difference, which is caused by a kickback voltage when the gray scale voltage has a positive (+) or negative (−) polarity, is distributed, thereby reducing flicker noise.

In the liquid crystal panel 110 having the pixel structure as shown in FIG. 2, in the case where the data signal having a maximum gray scale level is applied to the red sub-pixels R1 to Rn and the green sub-pixels G1 to Gn, and the data signal having a minimum gray scale level is applied to the blue sub-pixels B1 to Bn, the liquid crystal panel 110 displays the yellow color.

Figure 3:
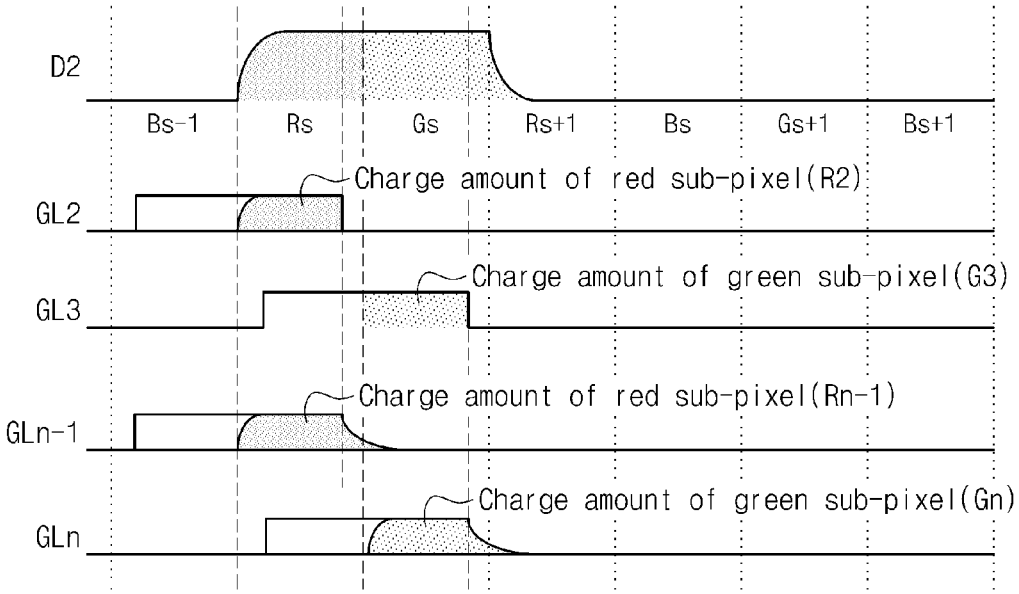
FIG. 3 is a timing diagram showing an operation of the liquid crystal panel when a yellow color is displayed on the liquid crystal panel shown in FIG. 2.

FIG. 3 is a timing diagram showing an operation of the liquid crystal panel when the yellow color is displayed on the liquid crystal panel shown in FIG. 2.

As shown in FIG. 3, when the gray scale voltage is applied to the data line DL2 for the red sub-pixel R2 after the gate line GL2 is activated, the red sub-pixel R2 is charged by the gray scale voltage. Similarly, when the gray scale voltage is applied to the data line DL2 for the green sub-pixel G3 after the gate line GL3 is activated, the green sub-pixel G3 is charged by the gray scale voltage. Continuously, when the gray scale voltage is applied to the data line DL2 for the red sub-pixel Rn-1 after the gate line GLn-1 is activated, the red sub-pixel Rn-1 is charged by the gray scale voltage. Similarly, when the gray scale voltage is applied to the data line DL2 for the green sub-pixel Gn after the gate line GLn is activated, the green sub-pixel Gn is charged by the gray scale voltage. That is, the voltages of data lines DL1, DL3, DL5, . . . DLm-1 are caused to swing between the maximum gray scale voltage level and the minimum gray scale voltage, and the data lines DL2, DL4, DL6, . . . , DLm may be maintained at the maximum gray scale voltage level.

In the case where the gate driver 144 shown in FIG. 1 sequentially drives the gate lines GL1 to GLn, a falling edge of the first and second gate clock signals CKV1 and CKV2 applied to the ASG circuits 201 to 211 in the gate driver 144 from the level shifter 142 is delayed as a result of noise from the wires. Since the gate driver 144 drives the gate lines GL1 to GLn in synchronization with the first and second gate clock signals CKV1 and CKV2, the delay at the falling edge of the first and second gate clock signals CKV1 and CKV2 affects the charge rate of the sub-pixels. As shown in FIG. 3, the charge amounts of the red and green sub-pixels Rn-1 and Gn respectively connected to the gate lines GLn-1 and GLn are increased more than the charge amounts of the red and green sub-pixels R2 and R3 respectively connected to the gate lines GL2 and GL3. Therefore, the brightness of the red sub-pixels is increased more than the brightness of the green sub-pixel the closer they are to a lower portion of the display screen of the liquid crystal panel 110.

In general, a brightness ratio of red, green, and blue sub-pixels included in one pixel is 20:70:10. The data signal from the data driver 130 disposed on the upper side of the liquid crystal panel 110 is applied to the sub-pixels through the data lines DL1 to DLm. Accordingly, the charge amount of the sub-pixels positioned at the upper side of the liquid crystal panel 110 is larger than the charge amount of the sub-pixels positioned at the lower side of the liquid crystal panel 110. As a result, the brightness of the green sub-pixel is greater than the brightness of the red sub-pixel in the upper side of the display screen, in which the delay of the falling edge of the first and second gate clock signals CKV1 and CKV2 is relatively small.

Thus, a greenish phenomenon occurs on the upper side of the display screen, in which the brightness of the green sub-pixel is greater than the brightness of the red sub-pixels, and a reddish phenomenon occurs on the lower side of the display screen, in which the brightness of the red sub-pixel is greater than the brightness of the green sub-pixel.

Figure 4:
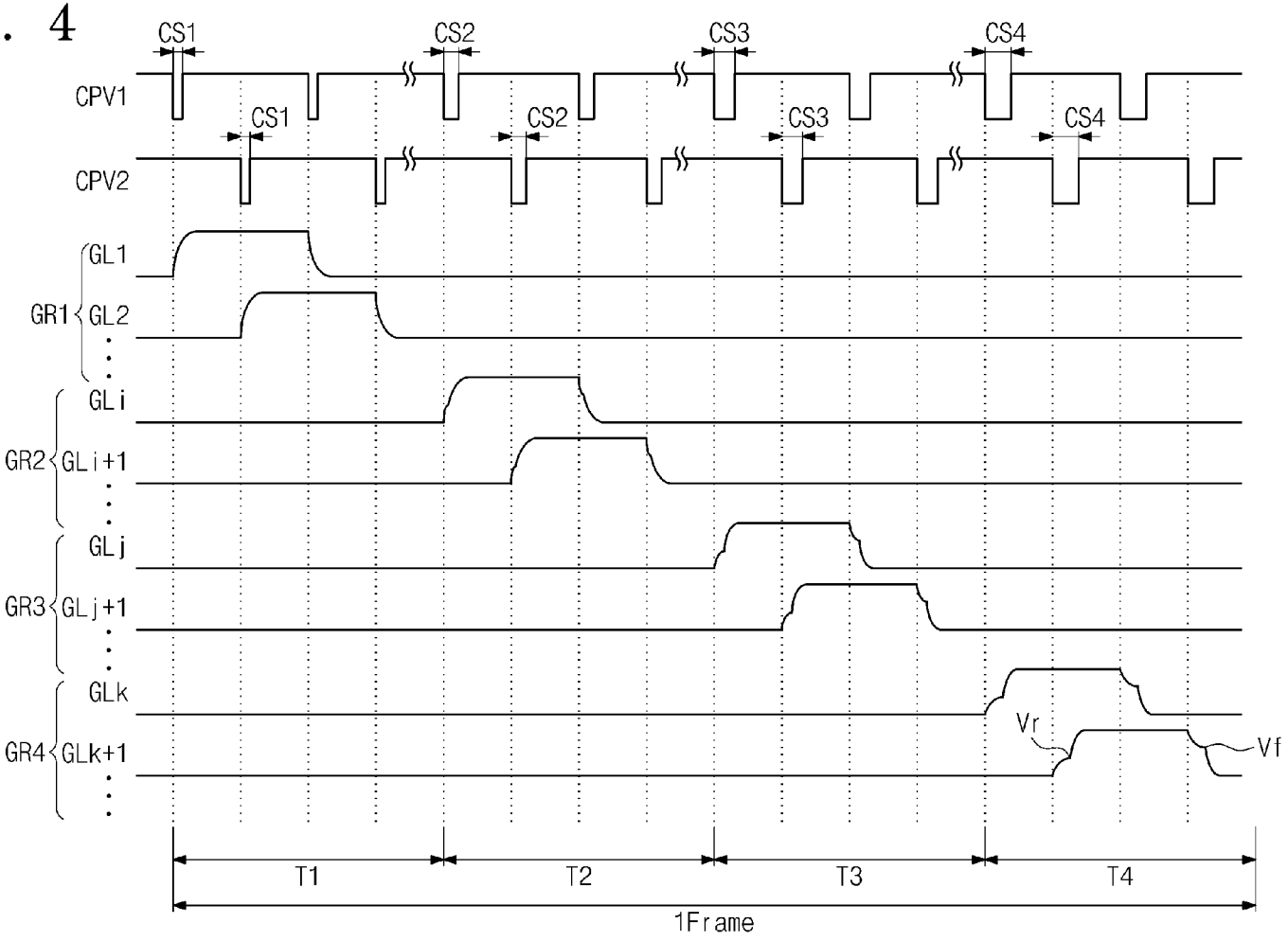
FIG. 4 is a timing diagram showing first and second gate pulse signals output from a timing controller shown in FIG. 1, and a voltage variation of gate lines according to the first exemplary embodiment of the present invention.

FIG. 4 is a timing diagram showing first and second gate pulse signals output from the timing controller shown in FIG. 1, and a voltage variation of gate lines according to the first exemplary embodiment of the present invention.

Referring to FIG. 4, a charge sharing time of each of the first and second gate pulse signals CPV1 and CPV2 output from the timing controller 120 shown in FIG. 1 may be differently set depending on a position of a corresponding gate line. The charge sharing time indicates a time in which each of the first and second gate pulse signals CPV1 and CPV2 is maintained at a low level.

Assuming that a time in which all gate lines GL1 to GLn are driven is one frame, each of the first and second gate pulse signals CPV1 and CPV2 is divided into first to fourth periods T1 to T4 within the one frame. The gate lines GL1 to GLn are grouped into four gate line groups GR1 to GR4, and the first to fourth periods T1 to T4 correspond to the four gate line groups GR1 to GR4, respectively.

The charge sharing time of each of the first and second gate pulse signals CPV1 and CPV2 is set to one of first to fourth charge sharing times CS1 to CS4 according to the position of the gate line corresponding to the pulse of each of the first and second gate pulse signals CPV1 and CPV2.

For instance, during the first period T1 in which the gate lines included in the first gate line group GR1 are driven, the charge sharing time of each of the first and second gate pulse signals CPV 1 and CPV2 is set to a first charge sharing time CS1. The charge sharing time of each of the first and second gate pulse signals CPV1 and CPV2 is set to a second charge sharing time CS2 during the second period T2 in which the gate lines included in the second gate line group GR2 are driven. The charge sharing time of each of the first and second gate pulse signals CPV1 and CPV2 is set to a third charge sharing time CS3 during the third period T3 in which the gate lines included in the third gate line group GR3 are driven. The charge sharing time of each of the first and second gate pulse signals CPV1 and CPV2 is set to a fourth charge sharing time CS4 during the fourth period T4 in which the gate lines included in the fourth gate line group GR4 are driven. The first, second, third, and fourth charge sharing times CS1, CS2, CS3, and CS4 have values that become larger in the order of the first, second, third, and fourth charge sharing times CS1, CS2, CS3, and CS4 (i.e., CS1<CS2<CS3<CS4).

In addition, as shown in FIG. 4, as the charge sharing time of the first and second gate pulse signals CPV1 and CPV2 becomes long, a rising voltage Vr of the signal used to drive the gate lines GL1 to GLn becomes high and a falling voltage Vf of the signal used to drive the gate lines GL1 to GLn becomes low. When the rising voltage Vr of the signal used to drive the gate lines GL1 to GLn is increased, the charge amount of the pixels is decreased. In addition, when the falling voltage Vf used to drive the gate lines GL1 to GLn is increased, the charge amount of the pixels is increased.

Since the rising voltage Vr used to drive the gate lines GL1 to GLn is increased the closer the gate lines GL1 to GLn are to the lower side of the display screen, an initial charge amount at the lower side of the display screen may be improved. Thus, the greenish phenomenon of the sub-pixels connected to the gate lines adjacent to the data driver 130 may be offset.

In addition, since the falling voltage Vf used to drive the gate lines GL1 to GLn is decreased the closer the gate lines GL1 to GLn are to the lower side of the display screen, a late charge amount at the lower side of the display screen may be reduced. Thus, the reddish phenomenon at the lower side of the display screen, which is caused by the delay of the first and second gate clock signals CKV1 and CKV2, may be offset.

FIG. 5A, FIG. 5B, FIG. 5C, and FIG. 5D are views showing experimental results of an operation of a level shifter shown in FIG. 1.

Figure 5A:
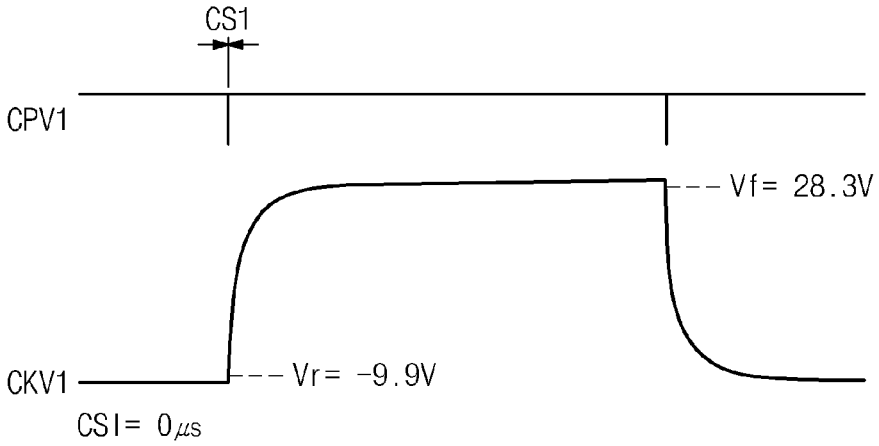
FIG. 5A, FIG. 5B, FIG. 5C, and FIG. 5D are views showing experimental results of an operation of a level shifter shown in FIG. 1.

Referring to FIG. 5A, in the case that the charge sharing time of the first gate pulse signal CPV1 output from the timing controller 120 is set to the first charge sharing time CS1 of about 0.0 μs, the rising voltage Vr of the first gate clock signal CKV1 output from the level shifter 142 is about −9.9 volts and the falling voltage Vf of the first gate clock signal CKV1 output from the level shifter 142 is about 28.3 volts.

Figure 5B:
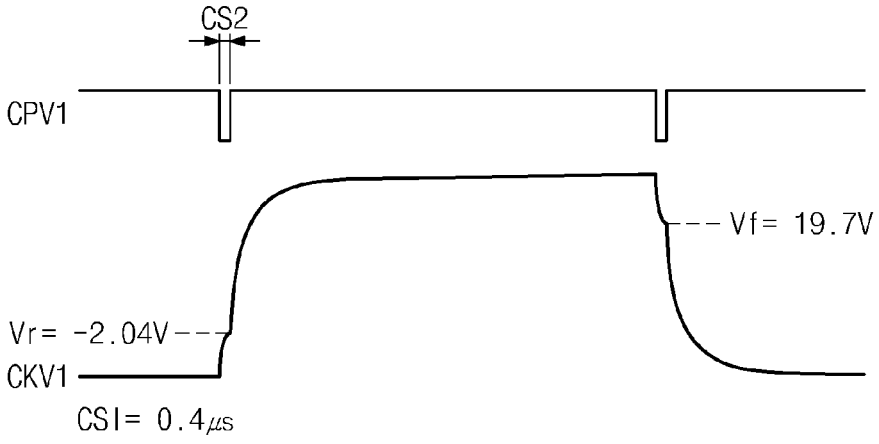

Referring to FIG. 5B, in the case that the charge sharing time of the first gate pulse signal CPV1 output from the timing controller 120 is set to the second charge sharing time CS2 of about 0.4 μs, the rising voltage Vr of the first gate clock signal CKV1 output from the level shifter 142 is about −2.04 volts and the falling voltage Vf of the first gate clock signal CKV1 output from the level shifter 142 is about 19.7 volts.

Figure 5C:
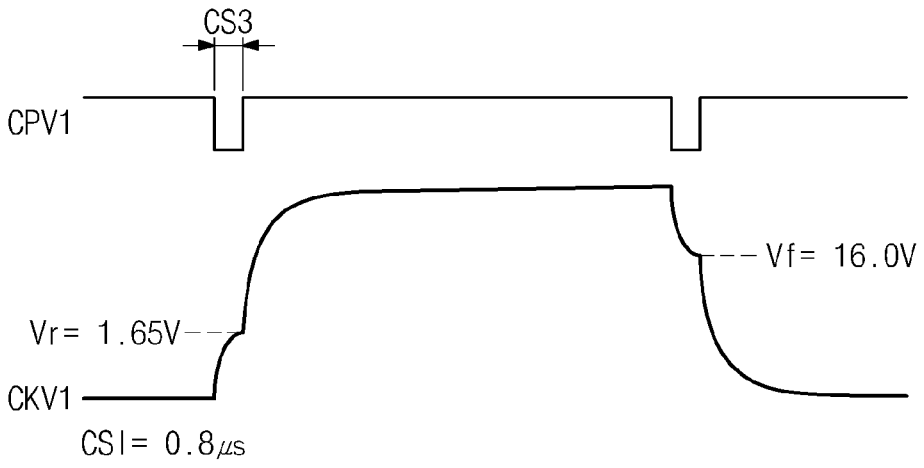

Referring to FIG. 5C, in the case that the charge sharing time of the first gate pulse signal CPV1 output from the timing controller 120 is set to the third charge sharing time CS3 of about 0.8 μs, the rising voltage Vr of the first gate clock signal CKV1 output from the level shifter 142 is about 1.65 volts and the falling voltage Vf of the first gate clock signal CKV1 output from the level shifter 142 is about 16.0 volts.

Figure 5D:
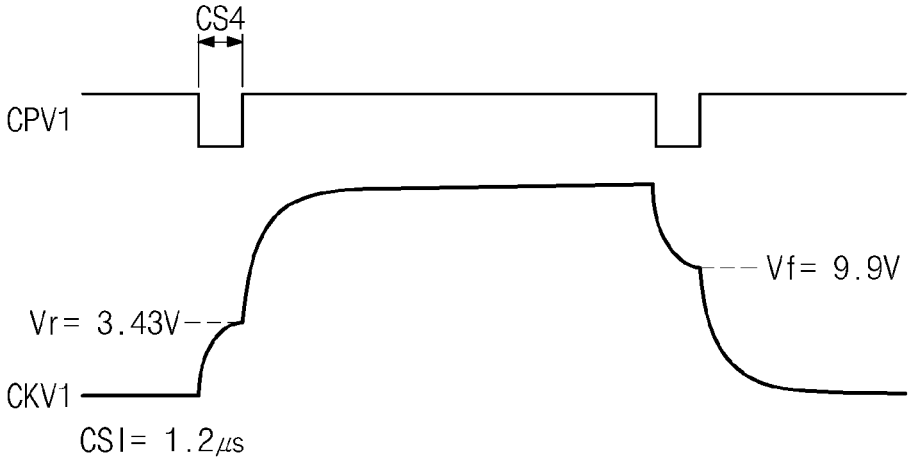

Referring to FIG. 5D, in the case that the charge sharing time of the first gate pulse signal CPV1 output from the timing controller 120 is set to the fourth charge sharing time CS4 of about 1.2 μs, the rising voltage Vr of the first gate clock signal CKV1 output from the level shifter 142 is about 3.43 volts and the falling voltage Vf of the first gate clock signal CKV1 output from the level shifter 142 is about 9.9 volts.

That is, as the charge sharing time of the first gate pulse signal CPV1 increases, the rising voltage Vr of the first gate clock signal CKV1 increases. As a result, the charge amount of the sub-pixels connected to the gate line driven by the first gate pulse signal CPV1 is enhanced at the rising edge of the signal used to drive the gate line.

In addition, as the charge sharing time of the first gate pulse signal CPV1 increases, the falling voltage Vf of the first gate clock signal CKV1 decreases. As a result, the charge amount of the sub-pixels connected to the gate line driven by the first gate pulse signal CPV1 is reduced at the falling edge of the signal used to drive the gate line. Therefore, although the falling edge of the signals used to drive the gate lines GL1 to GLn becomes long, the reddish phenomenon may be prevented from occurring since the charge amount is reduced.

Referring to FIG. 1 again, the timing controller 120 includes a register 121 to store count values corresponding to the number of the gate lines to which the first to fourth charge sharing times CS1 to CS4 are applied. For instance, when the number of the gate lines GL1 to GLn is 1024 and the gate lines GL1 to GLn are grouped into the first to fourth gate line groups GR1 to GR4, each of the first to fourth gate line groups GR1 to GR4 includes 256 gate lines. The register 121 of the timing controller 120 stores "256" indicating the number of the gate lines included in one gate line group. A counter (not shown) in the timing controller 120 changes the charge sharing time of the first and second gate pulse signals CPV1 and CPV2 when a value counted by the counter reaches the stored value in the register 121. The number of the gate lines included in each of the first to fourth gate line groups GR1 to GR4 need not be constant. In addition, the number of the gate line groups of the gate lines GL1 to GLn should not be limited to four groups. The timing controller 120 may further include registers respectively storing the first to fourth charge sharing times CS1 to CS4.

In addition, in the present exemplary embodiment, the timing controller 120 outputs the first and second gate pulse signals CPV1 and CPV2, but the number of the gate pulse signals may be three or four according to the method of driving the gate lines GL1 to GLn. The number of the gate pulse signals and the number of the gate clock signals may vary.

Figure 6:
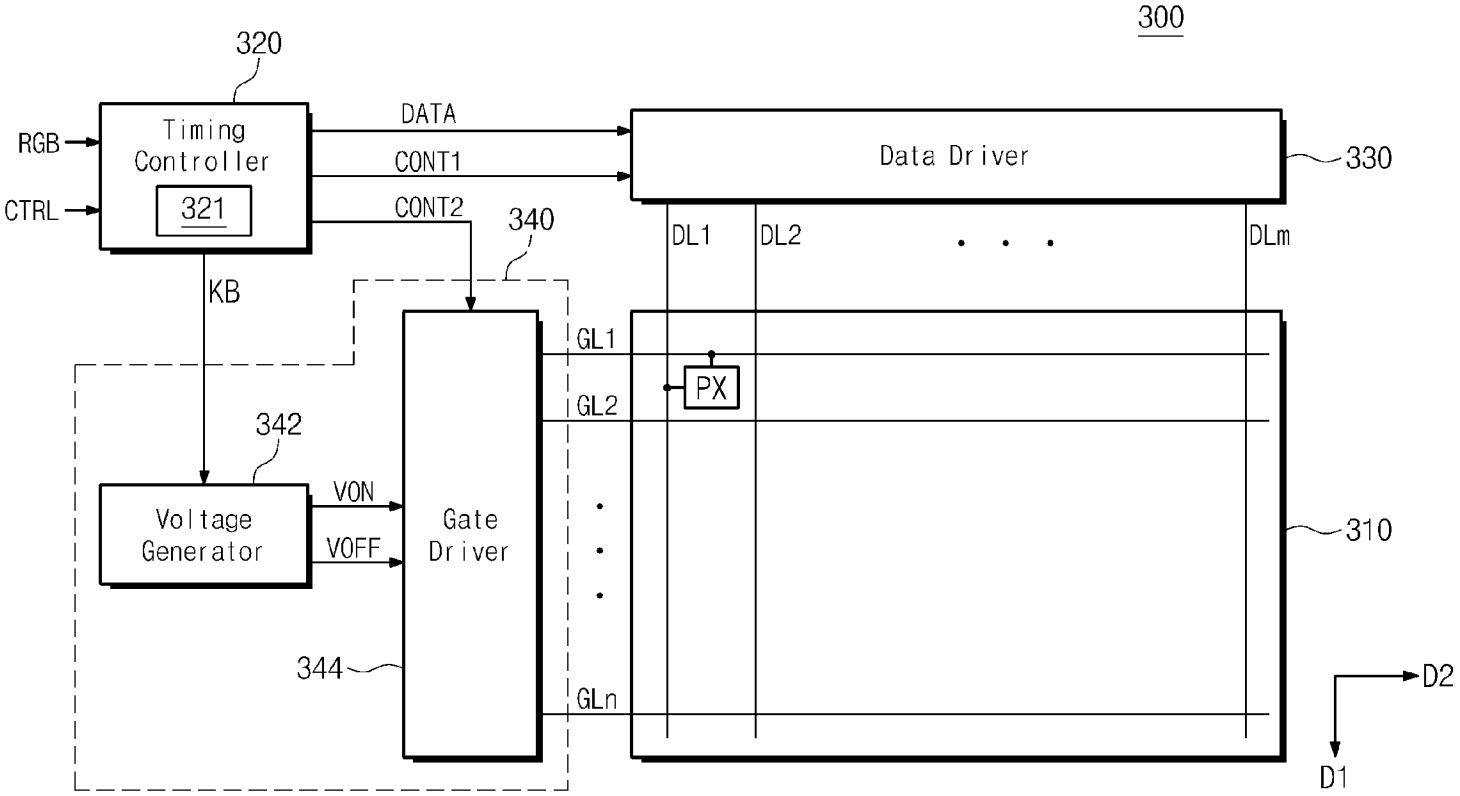
FIG. 6 is a block diagram showing a liquid crystal display according to a second exemplary embodiment of the present invention.

FIG. 6 is a block diagram showing a liquid crystal display according to a second exemplary embodiment of the present invention.

Referring to FIG. 6, a liquid crystal display 300 has a similar configuration to that of the liquid crystal display 100 shown in FIG. 1. However, a gate driving unit 340 of the liquid crystal display 300 includes a voltage generator 342 and a gate driver 344 different from the gate driving unit 140 shown in FIG. 1.

A timing controller 320 receives image signals RGB and control signals CTRL to control the display of the image signals RGB. The timing controller 320 provides data signals DATA obtained by processing the image signals RGB on the basis of the control signals CTRL and a first control signal CONT1 to a data driver 330, and provides a second control signal CTRL2 to a gate driver 340. The second control signal CONT2 may include a vertical synchronization signal STV1, an output enable signal OE, and first and second gate pulse signals CPV1 and CPV2 (not shown).

The timing controller 320 applies a kickback voltage KB to the voltage generator 342. The voltage generator 342 generates a gate-on voltage VON and a gate-off voltage VOFF in response to the kickback voltage KB. The voltage generator 342 may further generate a common voltage VCOM required to drive a liquid crystal panel 310 besides the gate-on voltage VON and the gate-off voltage VOFF.

The gate driver 344 sequentially drives gate lines GL1 to GLn in response to the gate-on voltage VON and the gate-off voltage VOFF from the voltage generator 342 and the second control signal CONT2 from the timing controller 320.

Figure 7:
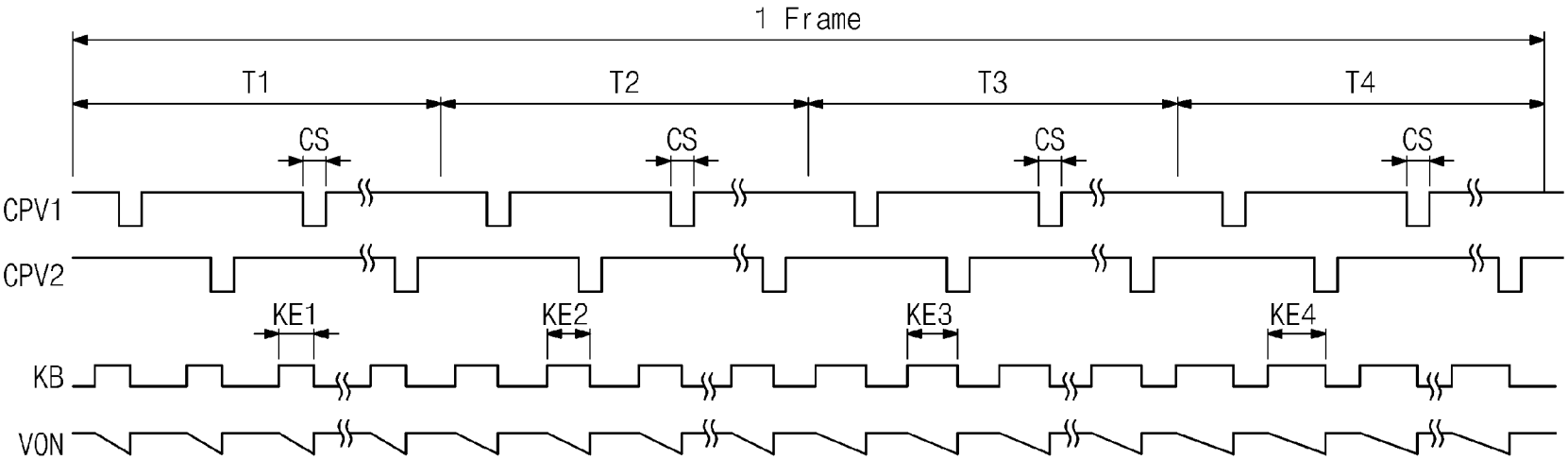
FIG. 7 is a timing diagram showing an operation of the liquid crystal display shown in FIG. 6.

FIG. 7 is a timing diagram showing an operation of the liquid crystal display shown in FIG. 6.

Referring to FIG. 6 and FIG. 7, a charge sharing time of first and second gate pulse signals CPV1 and CPV2 provided to the gate driver 344 from the timing controller 320 is constant at every pulse signal. An enable time of each pulse in the kickback voltage KB applied to the voltage generator 342 from the timing controller 320 may be determined depending on a position of a corresponding gate line of the gate lines GL1 to GLn.

As described in FIGS. 1 to 4, in the case that the gate lines GL1 to GLn are grouped into four groups GR1 to GR4, the enable time of the kickback signal KB may be set to one of first, second, third, and fourth kickback enable times KE1, KE2, KE3, and KE4.

Figure 8A:
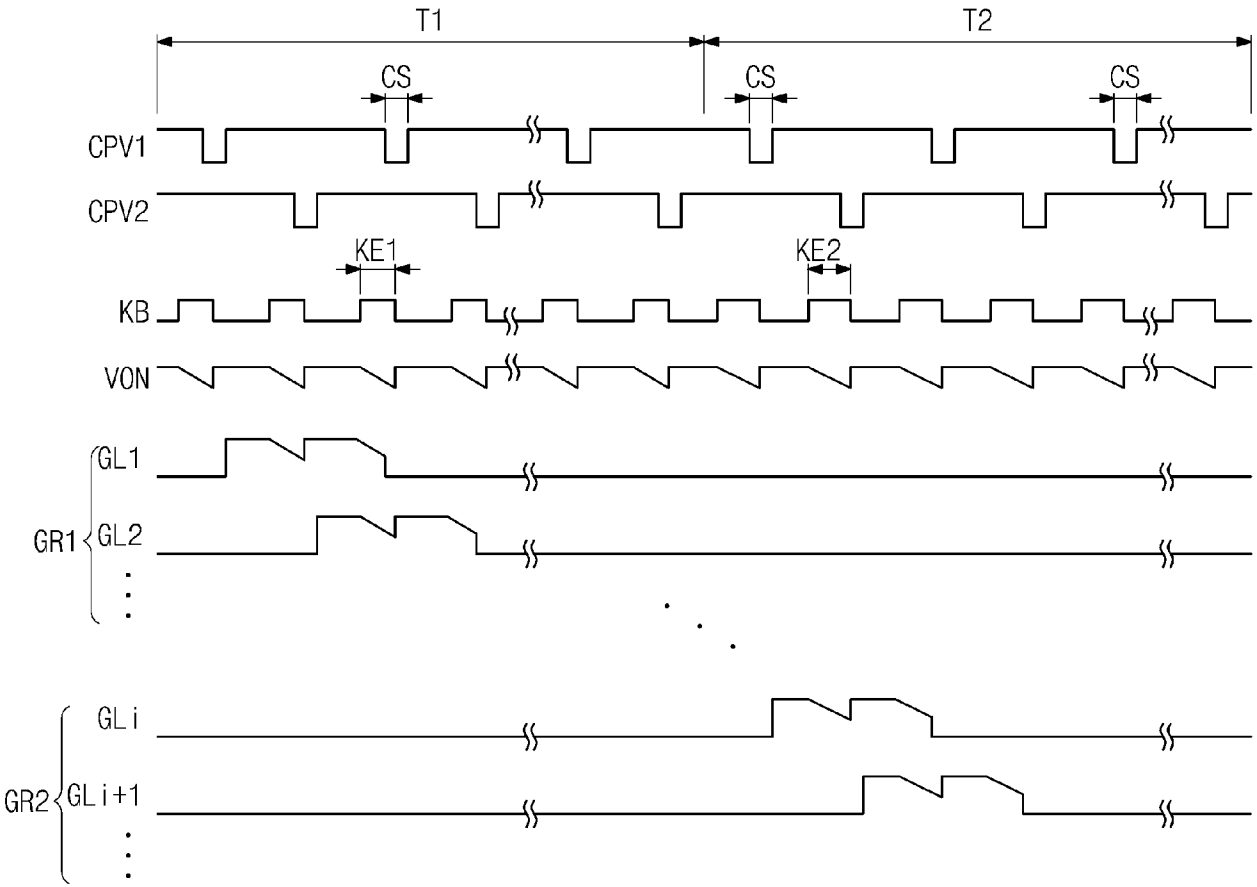
FIG. 8A and FIG. 8B are timing diagrams showing signals that drive gate lines according to an enable time of each pulse in a kickback signal shown in FIG. 7.
Figure 8B:
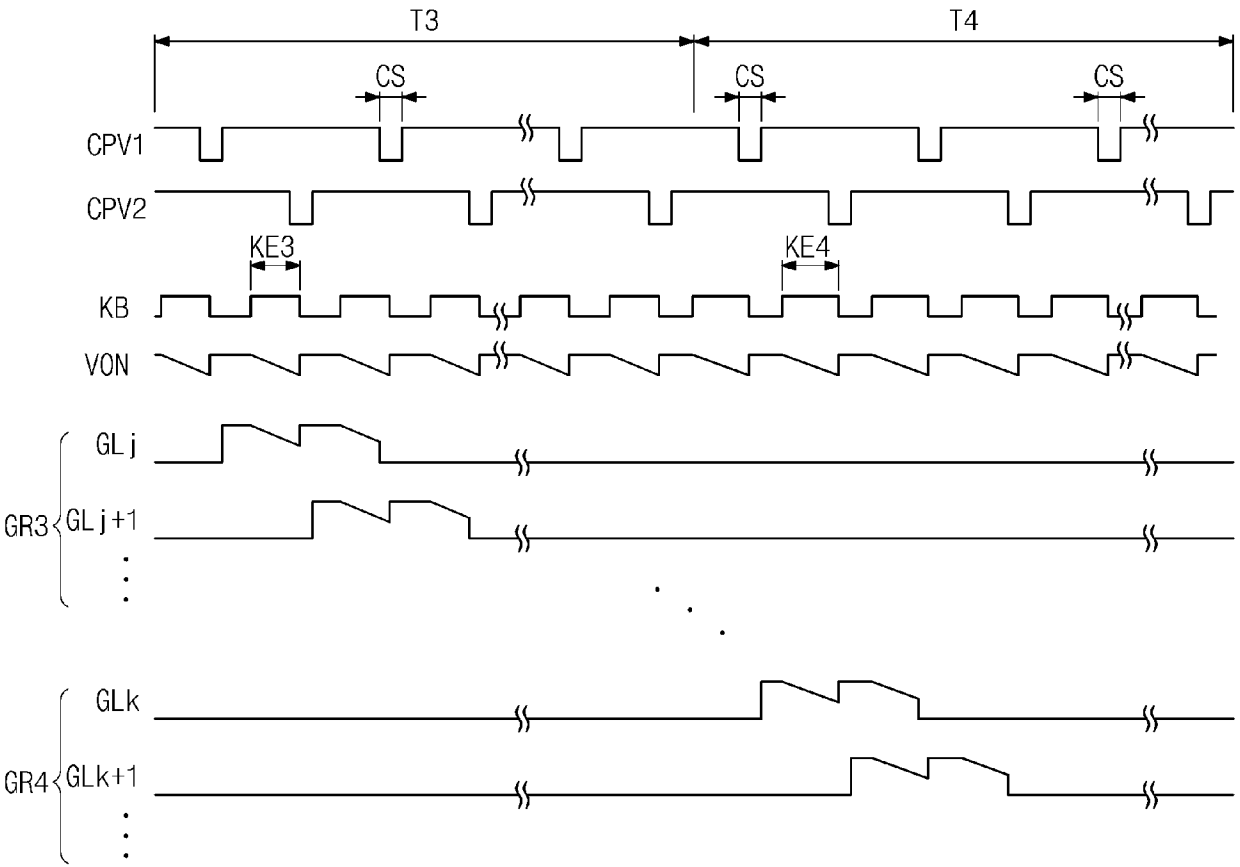

FIG. 8A and FIG. 8B are timing diagrams showing signals that drive the gate lines GL1 to GLn according to the enable time of each pulse in the kickback signal KB shown in FIG. 7.

Referring to FIGS. 7, 8A, and 8B, for example, the enable time of the kickback signal KB is set to the first kickback enable time KE1 during a first period T1 in which the gate lines included in the first gate line group GR1 are driven; the enable time of the kickback signal KB is set to the second kickback enable time KE2 during a second period T2 in which the gate lines included in the second gate line group GR2 are driven; the enable time of the kickback signal KB is set to the third kickback enable time KE3 during a third period T3 in which the gate lines included in the third gate line group GR3 are driven; and the enable time of the kickback signal KB is set to the fourth kickback enable time KE4 during a fourth period T4 in which the gate lines included in the fourth gate line group GR4 are driven. The first, second, third, and fourth kickback enable times KE1, KE2, KE3, and KE4 have values that become larger in the order of the first, second, third, and fourth kickback enable times KE1, KE2, KE3, and KE4 (i.e., KE1<KE2<KE3<KE4).

The voltage generator 342 shown in FIG. 6 generates the gate-on voltage VON in response to the kickback signal KB. As the enable time of the kickback signal KB becomes longer, a falling time of the gate-on voltage VON becomes faster.

Responsive to the first and second gate pulse signals CPV1 and CPV2 of the second control signal CONT2 from the timing controller 320, the gate driver 344 applies the gate-on voltage VON or the gate-off voltage VOFF to the gate lines GL1 to GLn to drive the gate lines GL1 to GLn.

As the enable time of the kickback signal KB becomes longer, the falling time of the signal used to drive the gate lines GL1 to GLn becomes faster. Therefore, since the charge amount of the sub-pixels is reduced as the enable time of the kickback signal KB becomes longer, the occurrence of the reddish phenomenon at the lower side of the display screen may be prevented.

Although exemplary embodiments of the present invention are described with the gate lines GL1-GLn being sequentially driven from the top of the panel to the bottom of the panel, other driving schemes are possible. For example, the gate lines may be driven sequentially from the bottom of the panel to the top of the panel (i.e., GLn to GL1). Another example includes an interlaced driving scheme where even gate lines are driven in a first half of the frame and odd gate lines are driven in the second half of the frame. As a person having ordinary skill in the art would understand, exemplary embodiments of the present invention can be applied to various gate line scanning schemes.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A display apparatus, comprising:

a plurality of pixels arranged in association with a plurality of gate lines and a plurality of data lines crossing the gate lines;

a data driver configured to drive the data lines;

a gate driving unit configured to drive the gate lines in synchronization with a gate control signal; and a timing controller configured to control the data driver and the gate driving unit in response to an image signal and an input control signal, wherein the timing controller is configured to output the gate control signal comprising a plurality of pulses respectively corresponding to the gate lines, and an enable time of each pulse of the plurality of pulses is set according to a position of a corresponding gate line of the gate lines, wherein:

the gate control signal is a gate pulse signal comprising the pulses respectively corresponding to the gate lines, and a charge sharing time of the gate pulse signal is set according to the position of the corresponding gate line of the gate lines;

the gate lines are grouped into K groups (where K is a natural number greater than 2), the timing controller is configured to output the gate pulse signal having charge sharing times respectively corresponding to the K groups, and the charge sharing time of the gate control signal is set according to a driving order of the group which includes the corresponding gate line; and the charge sharing times of the gate pulse signals for each group increase as each of the groups of the gate lines is consecutively driven in the driving order from 1 to K.

2. The display apparatus of claim 1, wherein the timing controller is configured to further output a first control signal to control the data driver and a second control signal to control the gate driving unit, and the gate driving unit comprises:

a level shifter configured to generate a gate clock signal in response to the gate pulse signal; and a gate driver configured to drive the gate lines in response to the second control signal and the gate clock signal from the timing controller.

3. The display apparatus of claim 1, wherein the timing controller comprises a register to store the charge sharing times of the gate pulse signal, which correspond to the K groups, respectively.

4. The display apparatus of claim 1, wherein the pixels comprise a red pixel, a green pixel, and a blue pixel, which are sequentially arranged in a direction in which the gate lines extend, a first group of the pixels is connected to a data line disposed at a left side thereof, and a second group of the pixels is connected to a data line disposed at a right side thereof.

5. The display apparatus of claim 4, wherein the pixels comprising the first group are alternately arranged with the pixels comprising the second group along a direction in which the data lines extend.

6. The display apparatus of claim 1, wherein the gate lines are driven such that the data lines connected to a next gate line are precharged while a data signal is applied to the pixels connected to a predetermined gate line.

* * * * *